US008532553B2

(12) United States Patent
Hasegawa

(10) Patent No.: US 8,532,553 B2
(45) Date of Patent: Sep. 10, 2013

(54) FIXING DEVICE AND IMAGE FORMING APPARATUS INCLUDING SAME

(75) Inventor: Kenichi Hasegawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 266 days.

(21) Appl. No.: 13/045,715

(22) Filed: Mar. 11, 2011

(65) Prior Publication Data

US 2011/0222934 A1 Sep. 15, 2011

(30) Foreign Application Priority Data

Mar. 12, 2010 (JP) ..... 2010-055651

(51) Int. Cl.
*G03G 15/20* (2006.01)

(52) U.S. Cl.
USPC ..... 399/329

(58) Field of Classification Search
USPC ..... 399/320, 329
See application file for complete search history.

(56) References Cited

U.S. PATENT DOCUMENTS

| | | | | |
|---|---|---|---|---|
| 5,400,123 | A | 3/1995 | Sato et al. | |
| 5,873,020 | A * | 2/1999 | Matsuura et al. | 399/329 |
| 6,131,009 | A | 10/2000 | Hasegawa | |
| 6,496,666 | B2 | 12/2002 | Hayashi et al. | |
| 6,591,081 | B2 | 7/2003 | Hasegawa | |
| 7,070,182 | B2 | 7/2006 | Hasegawa | |
| 7,515,850 | B2 | 4/2009 | Hasegawa | |
| 7,630,652 | B2 | 12/2009 | Hasegawa | |
| 7,835,680 | B2 * | 11/2010 | Nanjo et al. | 399/329 |
| 2006/0029411 | A1 | 2/2006 | Ishii et al. | |
| 2007/0014600 | A1 | 1/2007 | Ishii et al. | |
| 2007/0230983 | A1 * | 10/2007 | Nakamoto et al. | 399/69 |
| 2010/0092220 | A1 | 4/2010 | Hasegawa et al. | |
| 2010/0092221 | A1 | 4/2010 | Shinshi et al. | |
| 2010/0202809 | A1 | 8/2010 | Shinshi et al. | |
| 2010/0290822 | A1 | 11/2010 | Hasegawa et al. | |
| 2011/0026987 | A1 | 2/2011 | Hasegawa | |
| 2011/0026988 | A1 | 2/2011 | Yoshikawa et al. | |
| 2011/0044734 | A1 | 2/2011 | Shimokawa et al. | |
| 2011/0052237 | A1 | 3/2011 | Yoshikawa et al. | |
| 2011/0052245 | A1 | 3/2011 | Shinshi et al. | |
| 2011/0052282 | A1 | 3/2011 | Shinshi et al. | |
| 2011/0058862 | A1 | 3/2011 | Yamaguchi et al. | |
| 2011/0058864 | A1 | 3/2011 | Fujimoto et al. | |
| 2011/0058865 | A1 | 3/2011 | Tokuda et al. | |
| 2011/0058866 | A1 | 3/2011 | Ishii et al. | |

FOREIGN PATENT DOCUMENTS

| | | |
|---|---|---|
| JP | 4-50883 | 2/1992 |
| JP | 2004-198556 | 7/2004 |
| JP | 2004-252354 | 9/2004 |
| JP | 2007-334205 | 12/2007 |

* cited by examiner

*Primary Examiner* — Walter L Lindsay, Jr.
*Assistant Examiner* — Barnabas Fekete
(74) *Attorney, Agent, or Firm* — Oblon, Spivak, McClelland, Maier & Neustadt, L.L.P.

(57) ABSTRACT

A fixing device includes a rotary heating member; a heat source disposed near the rotary heating member to heat the rotary heating member; a stationary member disposed in sliding contact with a portion of an outer circumferential surface of the rotary heating member; a flexible fixing belt looped around the rotary heating member and the stationary member; and a rotary pressure member disposed in pressure contact with the stationary member via the fixing belt to form a nip between the fixing belt and the rotary pressure member. The rotary heating member, the stationary member, the fixing belt, and the rotary pressure member are arranged in a direction in which pressure is applied to form the nip. A pressing force acting between the rotary heating member and the rotary pressure member via the fixing belt and the stationary member creates pressure at the nip.

15 Claims, 6 Drawing Sheets

FIXING DEVICE AND IMAGE FORMING APPARATUS INCLUDING SAME

CROSS-REFERENCE TO RELATED APPLICATIONS

The present patent application claims priority pursuant to 35 U.S.C. §119 from Japanese Patent Application No. 2010-055651, filed on Mar. 12, 2010 in the Japan Patent Office, which is incorporated herein by reference in its entirety.

BACKGROUND

1. Field

Exemplary embodiments of the present disclosure relate to an image forming apparatus and a fixing device employed in the image forming apparatus, and more specifically, an electrophotographic image forming apparatus capable of forming images at high speed, and a fixing device employed in the image forming apparatus.

2. Description of the Background Art

Related-art image forming apparatuses, such as copiers, facsimile machines, printers, or multifunction apparatuses having at least one of copying, printing, scanning, and facsimile functions, typically form an image on a recording medium according to image data. In such an image forming apparatus, for example, a charger uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to make the electrostatic latent image visible as a toner image; the toner image is directly transferred from the image carrier onto a recording medium or is indirectly transferred from the image carrier onto a recording medium via an intermediate transfer member; a cleaner then cleans the surface of the image carrier after the toner image is transferred from the image carrier onto the recording medium; finally, a fixing device applies heat and pressure to the recording medium bearing the toner image to fix the toner image on the recording medium, thus forming the image on the recording medium.

In recent years, image forming apparatuses have advanced in terms of color processing, high image quality, and high throughput. In order to fix a color image at a high image quality, it is preferable that the time (hereinafter "nip time") during which a recording sheet contacts a fixing nip is, for example, 40 milliseconds to 60 milliseconds, and the pressure at the nip is equal to or more than, for example, 7 N/cm$^2$. In particular, for high-speed image forming apparatuses having a throughput of 50 ppm or more for A4 size recording media, recording sheets are transported at a relatively high speed. Accordingly, in order to obtain the above-described nip time, it is preferable that the width of the fixing nip is equal to or more than, e.g., 10 mm, and the surface pressure thereof is equal to or more than, e.g., 7 N/cm$^2$. Further, coated sheets (e.g., paper sheets coated with resin), which are generally used with high-speed machines, tends to produce defective toner images due to water vapor when passing through the nip. Accordingly, it is preferable to apply a higher surface pressure of, e.g., 12 N/cm$^2$ or more at the nip.

Further, in order to enhance the image quality, it is preferable to separate a recording sheet from the nip exit naturally, without excessive force or an unduly complicated structure. Therefore, various proposals have been made regarding the shape of the nip, the roller curvature at the nip exit, and the guide member. Also, there is a method for bringing a separation claw or the like into contact with the roller for forcibly separating recording sheets therefrom, but this method may cause wear flaws in the roller to be transferred to images, thereby degrading images.

Such high-speed image forming apparatuses often use belt fixing devices capable of easily obtaining the preferable nip width, like that described in JP-H04-050883-A. However, in order to obtain a large nip width of, e.g., 10 mm or more, and a high surface pressure, it is preferable to provide a large pressing force between the fixing roller and the pressing roller. Additionally, in order to obtain a nip width which is kept uniform in the axial direction without being bent by the pressing force, it is preferable to use a large-diameter roller of a diameter of, e.g., 50 mm or more, and having excellent strength.

Such a belt fixing device having a large-diameter roller inevitably results in a large size of the device itself, thus increasing the cost of components. Further, a reduced roller curvature at the nip exit tends to hinder natural separation of recording sheets, thus resulting in failures, such as curling of the recording sheet around the fixing belt due to the adhesion force of fused toner. Further, in cases of forcible separation using separation claws, images may be degraded.

Further, for a fixing device including a stationary member as a fixing member like those described in the above-described JP-2004-252354-A and JP-2004-198556-A, using the stationary member as the fixing member causes the fixing belt to slide over the stationary member, resulting in a reduced running performance of the fixing belt due to the sliding resistance, wear degradation of the respective members, and the like.

To cope with such a challenge, for example, conventional techniques like those described in JP-2004-252354-A and JP-2004-198556-A propose to use a roller in the stationary member to reduce the sliding resistance or modify the materials of components and grease. However, the stationary member is smaller than the large-diameter roller, resulting in insufficient strength. As a result, a high surface pressure cannot be obtained, thus preventing the enhancement of image quality.

For the fixing device like that described in JP-2007-334205-A, it is conceivable to obtain a high surface pressure by increasing the diameter of the heating member and using a larger reinforcement member, and to obtain a wider nip by adjusting the shape of the nip. However, if an increased diameter of the heating member is used, the roller curvature at the nip exit is reduced, preventing natural separation of a recording sheet. As a result, the recording sheet may be curled around the fixing belt by the adhesion force of fused toner, as with the belt fixing device described in JP-H04-050883-A. Further, it is hard to optimize both the heat transmission performance and the running performance of the fixing belt simultaneously, thus making it hard to employ the above-described belt fixing device in a high-speed image forming apparatus.

SUMMARY

In an aspect of this disclosure, there is provided an improved fixing device including a rotary heating member, a heat source, a stationary member, a flexible fixing belt, and a rotary pressure member. The heat source is disposed near the rotary heating member to heat the rotary heating member. The stationary member is disposed in sliding contact with a portion of an outer circumferential surface of the rotary heating member. The fixing belt is looped around the rotary heating member and the stationary member. The rotary pressure member is disposed in pressure contact with the stationary member via the fixing belt to form a nip between the fixing belt and the rotary pressure member. A pressing force acting between the rotary heating member and the rotary pressure member via the fixing belt and the stationary member creates pressure at the nip.

In an aspect of this disclosure, there is provided an improved image forming apparatus including the fixing device described above.

BRIEF DESCRIPTION OF THE DRAWINGS

Additional aspects, features, and advantages of the present disclosure will be readily ascertained as the same becomes better understood by reference to the following detailed description when considered in connection with the accompanying drawings, wherein.

Figure 1:
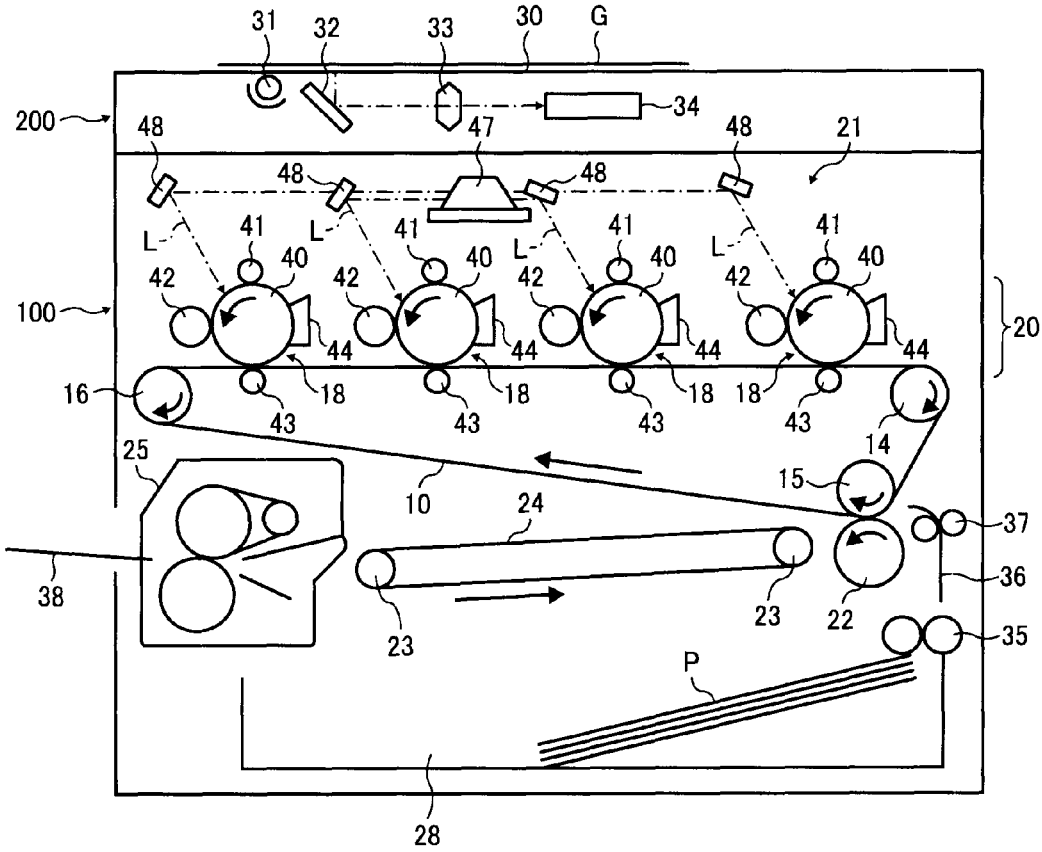
FIG. 1 is a schematic configuration view of an image forming apparatus according to an exemplary embodiment of the present disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, wherein like reference numerals designate identical or corresponding parts throughout the several views, exemplary embodiments of the present disclosure are described below with reference to FIGS. 1 to 8.

FIG. 1 is a schematic view of an image forming apparatus including a fixing device according to an exemplary embodiment of the present disclosure.

In FIG. 1, the image forming apparatus 100 is a color printer. It is to be noted that the image forming apparatus is not limited to the color printer as illustrated in FIG. 1 and may be any other suitable type of image forming apparatus. The image forming apparatus 100 includes an intermediate transfer member 10 of, e.g., an endless-belt type at the center thereof.

The intermediate transfer member 10 is looped around a driving roller 14, a first driven roller 15 and a second driven roller 16 to circulate in the clockwise direction in FIG. 1. The intermediate transfer member 10 may be looped around four or more rollers including, for example, a roller for correcting the positional deviation thereof. In FIG. 1, the intermediate transfer member 10 is extended substantially horizontally. Alternatively, the intermediate transfer member 10 may be extended obliquely.

The image forming apparatus 100 further includes a belt cleaning device near the second driven roller 16 to remove residual toner remaining on the intermediate transfer member 10 after image transfer.

Further, above the intermediate transfer member 10 extended between the driving roller 14 and the second driven roller 16, four single-color image forming units 18 for, e.g., black, yellow, magenta and cyan, are arranged along a running direction of the intermediate transfer member 10. The single-color image forming units 18 collectively form a tandem image forming device 20. An exposure device 21 is further provided above the tandem image forming device 20.

On the other hand, under an area where the intermediate transfer member 10 is extended is provided a secondary transfer device 22 including a roller. The secondary transfer device 22 is pressed against the first driven roller 15 to transfer single-color images from the intermediate transfer member 10 onto a recording medium P. In FIG. 1, beside the secondary transfer device 22, a conveyance belt 24 of an endless shape is extended between two rollers 23. Beside the conveyance belt 24 is provided a fixing device 25 to fix the transferred images on the recording medium P.

The secondary transfer device 22 also feeds the recording medium P having the images transferred from the intermediate transfer member 10 to the conveyance belt 24. It is to be noted that a non-contact type charger may be used as the secondary transfer device 22. In such a case, a sheet feed mechanism may be provided separately from the non-contact type charger of the secondary transfer device 22.

Further, below the secondary transfer device 22, the conveyance belt 24 and the fixing device 25 is provided a medium housing cassette 28 that store recording media P, such as paper sheets or OHP films.

When copying is performed using the image forming apparatus, a document G is set on a document table 30 of a scanner 200 and pressed by a document retainer. Further, when a start button is pressed, the scanner 200 is activated to optically read the document. Thus, when the document G is illuminated by a light source 31, e.g., a halogen lamp, reflected light from the document G is further reflected by a mirror 32. The reflected light passes through a lens 33 to be condensed onto a CCD 34 and converted at the CCD 34 to electric signals. Thus, an image on the document G is converted to electrical signals.

Further, when the start button is pressed, a driving motor starts to rotate the driving roller 14. In accordance with rotation of the driving roller 14, the driven rollers 15 and 16 rotate, thus circulating the intermediate transfer member 10. At the same time, in the single-color image forming units 18, image bearing members 40 are rotated to form single-color images of black, yellow, magenta, and cyan thereon. Further, as the intermediate transfer member 10 circulates, the single-color images are transferred and superimposed onto the intermediate transfer member 10 to form a composite color image on the intermediate transfer member 10.

Meanwhile, when the start button is pressed, feed rollers 35 rotates to feed a recording medium P from the sheet tray 28 into a feed path 36. The recording medium P fed by the feed rollers 35 impinges on registration rollers 37 and stops there.

Further, in synch with conveyance of the composite color on the intermediate transfer member 10, the registration rollers 37 are rotated to feed the recording medium P to a secondary transfer nip between the intermediate transfer member 10 and the secondary transfer device 22. Thus, the composite color image on the intermediate transfer member 10 is collectively transferred onto the recording medium P, thus obtaining a desired color image on the recording medium P.

After the image transfer at the secondary transfer device 22, the recording medium P is conveyed by the conveyance belt 24 to the fixing device 25. In the fixing device 25, heat and pressure are applied to the recording medium P to fix the transferred images on the recording medium P. Then, the recording medium P is stacked on an output tray 38.

Meanwhile, after the image transfer at the secondary transfer device 22, the belt cleaning device removes residual toner remaining on the intermediate transfer member 10 to get ready for next image formation by the tandem image forming device 20.

In each of the single-color image forming units 18 of the tandem image forming device 20, the image bearing member 40 of a drum shape is surrounded by, for example, a charging device 41, a development device 42, a primary transfer device 43, a cleaning device 44, and a discharging device, which is not illustrated, and the like.

All or some of the components of each single-color image forming unit 18 may be integrally formed as a process cartridge removably mountable to the image forming apparatus 100, thus enhancing easiness of servicing operation.

The charging devices 41 (e.g., charging rollers in FIG. 1) apply voltage to the image bearing members 40 in contact therewith, thus electrically charging the image bearing members 40.

Each of the development devices 42 uses two-component developer containing magnetic carrier particles and nonmagnetic toner particles.

The primary transfer devices 43 of a roller type are pressed against the corresponding image bearing members 40 with the intermediate transfer member 10 interposed therebetween. It is to be noted that the primary transfer devices 43 are not limited to such a roller type and may be brush-type or non-contact-type chargers.

The cleaning devices 44 include cleaning members, such as cleaning blades or cleaning brushes, in contact with the image bearing members 40, and remove residual toner on the image bearing members 40 by using the cleaning members.

The discharging devices are for example, lamps to initialize the surface potential of the image bearing members 40 by directing light thereto.

Further, as each of the image bearing members 40 rotate, the surface of the corresponding image bearing member 40 is uniformly charged by the corresponding charging device 41. In the exposure device 21, writing light L is emitted from a light source, such as a laser or an LED in accordance with image data optically read by the scanner 200. The writing light L is reflected by a polygon mirror 47, reflected by mirrors 48, and directed to the image bearing members 40 to form electrostatic latent images on the image bearing members 40.

The development devices 42 supplies toners to the image bearing members 40 to convert the electrostatic latent images into visible images, and the visible images are transferred onto the intermediate transfer member 10 by the primary transfer device 43. After the image transfer, the cleaning devices 44 remove the residual toners from the surfaces of the image bearing members 40, and the discharging devices discharge the intermediate transfer member 10 to get ready for next image formation.

Next, the fixing device according to an exemplary embodiment of the present disclosure is described in more detail. The fixing device includes, for example, a rotary heating member (a heating roller 78) to rotate while being heated by a heat source (a heat source 84), a stationary member (a stationary member 74) in sliding contact with a portion of the outer circumferential surface of the rotary heating member, a flexible fixing belt (a fixing belt 77) looped around the rotary heating member and the stationary member, and a rotary pressure member (a pressure roller 72) in pressure contact with the stationary member with the fixing belt interposed therebetween to form a nip between the fixing belt and the rotary pressure member. The pressure at the nip is created by the pressing force acting between the rotary heating member and the rotary pressure member with the fixing belt and the stationary member interposed therebetween. Further, the term "peripheral direction" used herein refers to a rotation direction of the rotary heating member, and the term "axial direction" used herein refers to a direction parallel to the rotation axis of the rotary heating member.

Figure 2:
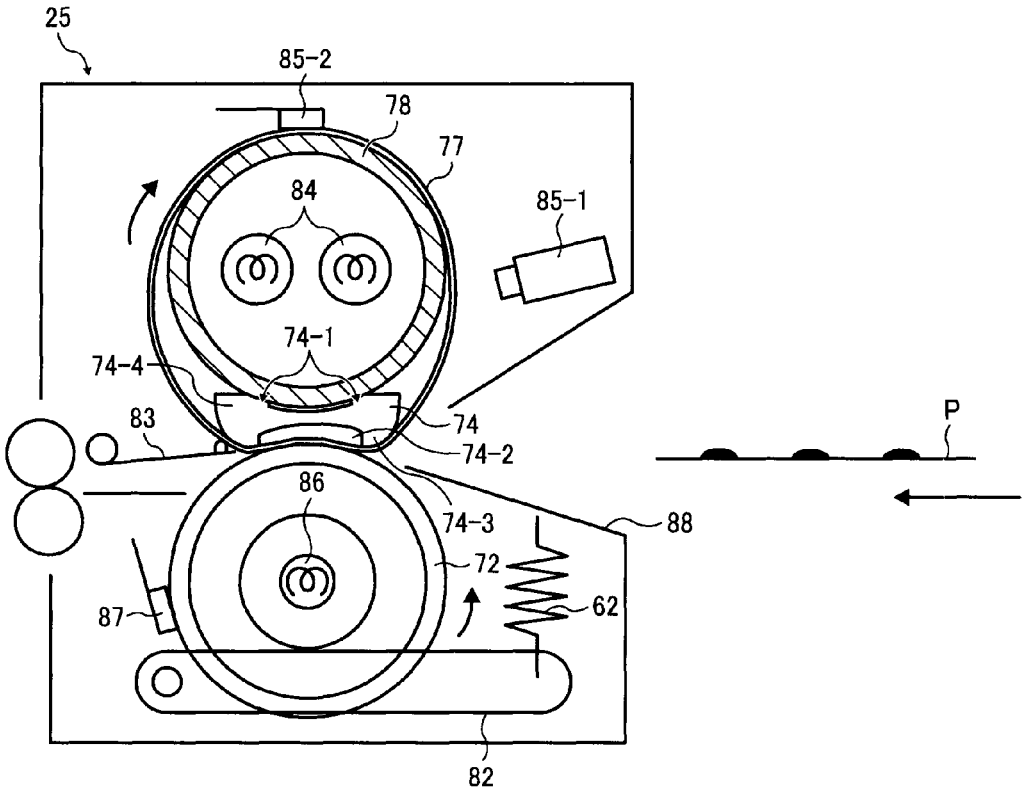
FIG. 2 is a schematic configuration view of a fixing device according to an exemplary embodiment of the present disclosure.
Figure 3:
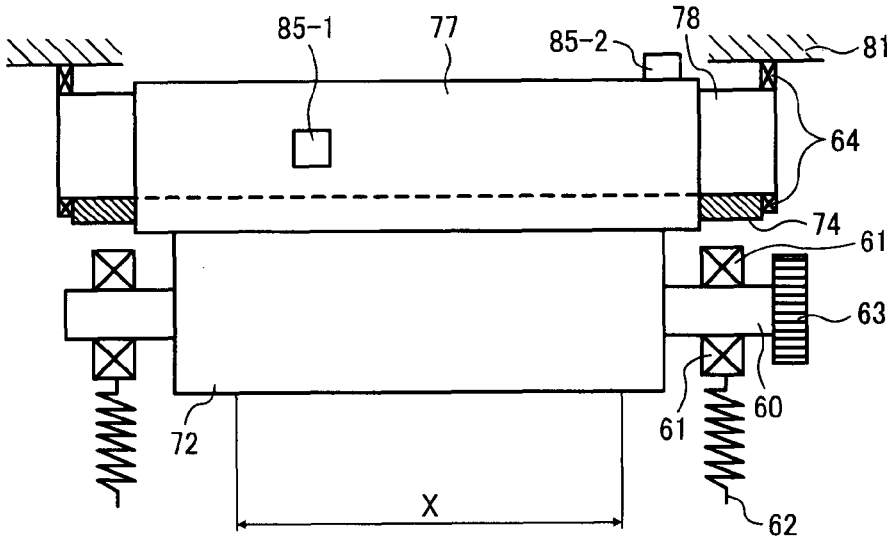
FIG. 3 is a side view of a fixing device according to an exemplary embodiment of the present disclosure.

FIG. 2 is a schematic configuration view (a front view) of the fixing device 25 according to this exemplary embodiment. Further, FIG. 3 is a right-side view of the fixing device illustrated in FIG. 2.

The fixing device 25 includes, for example, the heating roller 78, the stationary member 74, the flexible fixing belt 77, and the pressure roller 72. The heating roller 78 is rotatably supported by a frame. The stationary member 74 is disposed in sliding contact with a portion of the outer circumferential surface of the heating roller 78 and held so as to be movable only in the vertical direction in FIG. 2. The flexible fixing belt 77 is looped in, e.g., an elliptical shape around the outside of the heating roller 78 and the stationary member 74. The pressure roller 72 is pressed against the stationary member 74 with the fixing belt 77 interposed therebetween, thereby forming a fixing nip (which refers to a portion at which the fixing belt 77 and the pressure roller 72 contact with each other).

The fixing belt 77 is closely contacted with the stationary member 74 by the pressure roller 72. In addition, the fixing belt 77 induces a force (tension) for restoring its original circular shape and, thus, comes into close contact with the heating roller 78.

A pressing force acts on the pressure roller 72 in a substantially-vertically upward direction in FIG. 2, and is transmitted to the fixing belt 77, the stationary member 74 and the heating roller 78. Consequently, pressure is applied to the fixing nip, a portion at which the stationary member 74 and the fixing belt 77 contact with each other, and a portion at which the stationary member 74 and the heating roller 78 contact with each other.

Near the exit of the fixing nip for the fixing belt 77, a separation plate 83 for assisting separation of a recording sheet P from the fixing belt 77 is disposed at a position at which a front edge of the recording medium P does not contact the fixing belt 77. The separation plate 83 has a rotational fulcrum at a portion downstream thereof in the conveyance direction of the recording sheet P and has a positioning portion near one end thereof (outside the width of the recording sheet P in the axial direction). The positioning portion is biased toward the fixing belt 77 by a spring member or other biasing member, thus creating a minute gap between the end of the separation plate 83 and the fixing belt 77. Accordingly, the recording sheet P is naturally (smoothly) separated from the fixing belt 77 near the exit of the fixing nip and guided by the separation plate 83, thus preventing the recording sheet P from curling around the fixing belt 77.

The heating roller 78 includes the heat source 84 inside thereof. The heat source may be, for example, a halogen heater, an infrared heater, an induction heater, or a thermal resistance.

A thermopile 85-1 detects the surface temperature of the fixing belt 77 looped around the heating roller 78 at a position at which the fixing belt 77 passes immediately after separating from the heating roller 78. Further, the thermopile 85-1 is disposed away from the fixing belt 77 within a range of the widths of compatible recording media P in the axial direction, i.e., within a sheet-pass area indicated by a double arrow X in FIG. 3.

Further, a thermistor 85-2 detects the surface temperature of the fixing belt 77 at a portion at which the fixing belt 77 is looped around the heating roller 78. The thermistor 85-2 is disposed in contact with the fixing belt 77 outside the range of the widths of compatible recording media P in the axial direction, i.e., outside the sheet-pass area indicated by the double arrow X in FIG. 3.

When the fixing belt 77 is stopped, a controller control the turning on/off of the heat source 84 in accordance with the temperature detected by the thermistor 85-2 to maintain the heating roller 78 at a predetermined temperature. By contrast, when the fixing belt 77 is rotating, the controller controls the turning on/off of the heat source 84 in accordance with the temperature detected by the thermistor 85-1 to maintain the heating roller 78 at a predetermined temperature.

The pressure roller 72 also includes a heat source 86 such as a halogen heater inside thereof, and a thermistor 87 is pressed against the pressure roller 72. A controller controls the turning on/off of the heat source 86 to maintain the pressure roller 72 at a predetermined temperature in accordance with the temperature detected by the thermistor 87.

An entry guide 88 is provided at the entry-side of the fixing device 25 to guide a recording sheet P toward the fixing nip.

The thermistor 85-2 and the butting portion of the separation plate 83 contacting the surface of the fixing belt 77 are disposed outside the sheet width. Such a configuration prevents wear scars in the sheet width area of the fixing belt 77, thus preventing image degradation due to the scars transferred onto a toner image on a recording sheet P.

For the present exemplary embodiment, the pressure roller 72 includes a metal pipe made of, e.g., steel and a silicon rubber layer with a thickness of 2 mm on the metal pipe, has a diameter of 50 mm, and further includes journal portions 60 with a reduced diameter of 20 mm at its opposite ends. Bearings 61 are provided on the journal portions 60 at the opposite ends and pressed toward the heating roller 78 by a pressing unit including springs 62 and pressing levers 82 which are pivotably provided in a frame 81. A gear 63 on an end portion of the pressure roller is driven by a driving unit to rotate in the counterclockwise direction in FIG. 2. Thus, the pressure roller 72 having the above-described structure is rotated, thereby rotating the fixing belt 77 at the fixing nip.

The heating roller 78 includes, for example, an aluminum pipe (of a hollow cylindrical shape) having a high heat conductivity, a thickness of approximately 0.5 mm to approximately 3 mm, and a diameter of approximately 50 mm. The outer surface of the pressure roller 78 is processed by, e.g., alumite processing or fluorocarbon-resin processing to prevent wear due to contact thereof with the fixing belt 77 and slidable contact thereof with the stationary member 74. The inner surface of the pressure roller 78 is processed by heat-resistant black coating to facilitate absorption of heat from the heat source 84.

The heating roller 78 is rotatably fixed and supported, at its opposite end portions, to and on the frame 81 with bearings 64 interposed therebetween. The heating roller 78 having the above-described structure heats the fixing belt 77 while being rotated by the rotation of the fixing belt 77. The heating roller 78 has rigidity enough to be hardly bent even when receiving pressure from the pressure roller 72.

The stationary member 74 slidingly contacts the heating roller 78 at its upper surface and the fixing belt 77 at its lower surface. In FIG. 3, the length of the stationary member 74 in the horizontal direction is set smaller than the outer diameter of the heating roller 78 and larger than the width of the fixing nip. Further, the size of the stationary member 74 in the vertical direction is set to a size so that the fixing belt 77 is loosely extended by both the heating roller 78 and the stationary member 74.

It is preferable that the stationary member 74 includes a heat-resistant resin that has high heat-resistant characteristics and slidability and is less prone to induce heat migration from the heating roller 78. For example, polyphenylene sulfide (PPS), polyamide-imide (PAI), polyimide (PI), and the like may be used.

Further, an opposing surface of the stationary member 74 opposing the fixing belt 77 may partially include a heat-resistant elastic member 74-2, e.g., a silicon rubber, thus enhancing the close contact between the fixing belt 77 and a recording sheet P and increasing image quality. Further, it is preferable that the opposing surface of the stationary member 74 is coated with fluorocarbon-resin or provided with a fluorocarbon-resin sheet to reduce the sliding resistance.

Figure 7:
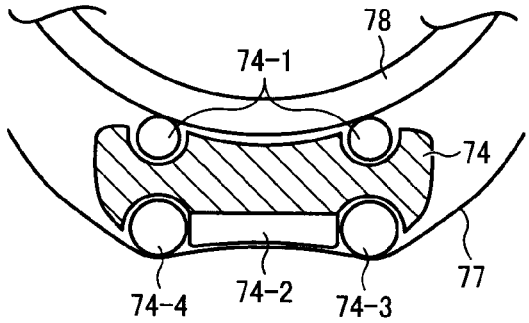
FIG. 7 is a schematic view of a stationary member including rollers.
Figure 8:
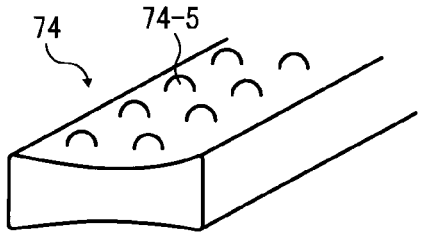
FIG. 8 is a schematic view of a stationary member having protrusions.
Figure 9:
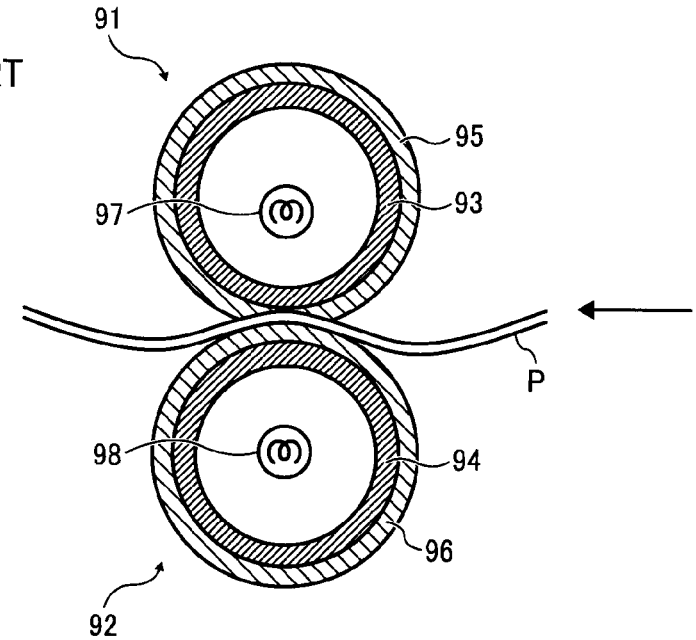
FIG. 9 RELATED ART
FIG. 9 is a schematic view of a conventional roller-fixing device.
Figure 10:
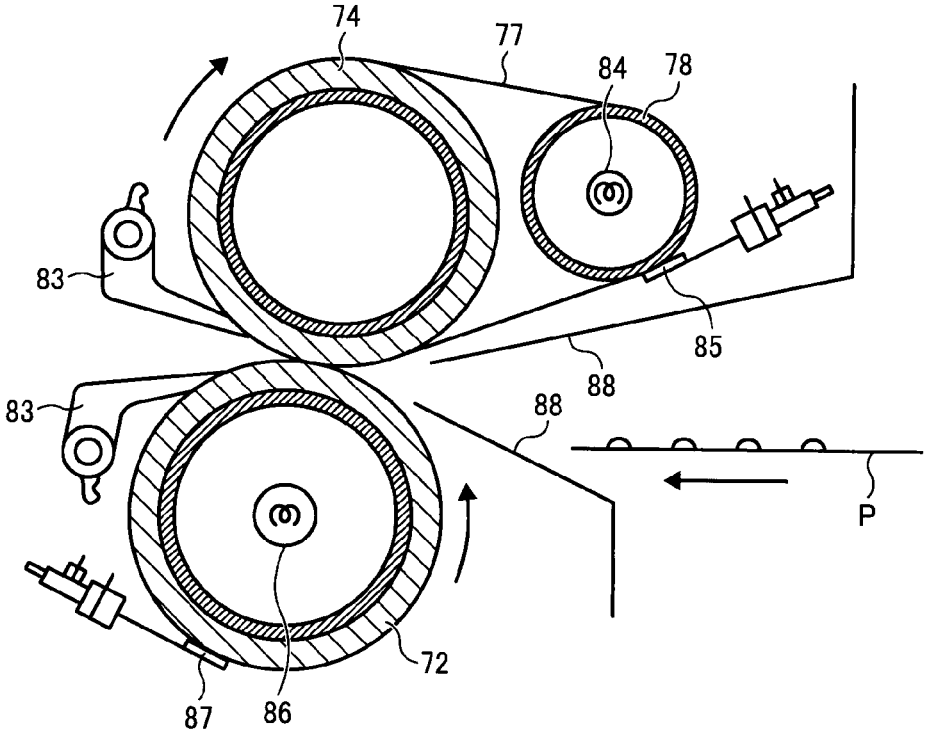
FIG. 10 RELATED ART
FIG. 10 is a schematic view of a conventional belt-fixing device.

Further, an opposing surface of the stationary member 74 opposing the heating roller 78 slidingly contacts the heating roller 78 at, e.g., two contact portions 74-1 in the circumferential direction in FIG. 2. It is preferable that the opposing surface of the stationary member 74 opposing the heating roller 78 has a low sliding resistance to the heating roller 78 and is less prone to induce heat migration. For example, the contact portions 74-1 may be rotary members, e.g., rollers as illustrated in FIG. 7, or a plurality of semispherical protrusions 74-5 on the opposing surface of the stationary member 74 opposing the heating roller 78, as illustrated in FIG. 8, to reduce the contact area. Such configurations can reduce the sliding resistance and heat migration between the stationary member 74 and the heating roller 78.

The opposing surface of the stationary member 74 opposing the fixing belt 77 has a surface curved in the same direction as that of the outer surface of the pressure roller 78, thus forming the fixing nip. For the convex shape of the fixing nip protruding toward the stationary member 74, a recording sheet P is ejected along a direction closer to the pressure roller 72 than the fixing belt 77, thus preventing the recording sheet P from curling around the fixing belt 77. It is to be noted that the shape of the fixing nip is not limited to the convex shape. For example, the surface of the stationary member 74 opposing the fixing belt 77 may be flattened to form a flat shape of fixing nip. Such a flat shape of the fixing nip obtains a good conveyance performance of a recording sheet P, thus suppressing occurrence of sheet feeding failure, such as cockling.

Further, a fixing-belt introducing portion (entry) 74-3 and/or a fixing-belt exit 74-4 at left and right portions in the opposing surface of the stationary member 74 opposing the fixing belt 77 have shapes of smaller R values in the same direction as that of the outer surface of the heating roller. The fixing belt 77 is extended to contact the two R portions. If a fixing nip is formed by a pair of rollers of a diameter of 50 mm, an exit of the fixing nip has a smaller curvature (R=25 mm), thus preventing natural separation of a recording sheet therefrom. By contrast, for the above-described configuration, the exit of the fixing nip has a larger curvature (e.g., R=8 mm), thus facilitating natural separation of recording sheets therefrom.

Further, it is preferable that the fixing-belt introducing portion 74-3 and the fixing-belt exit 74-4 have smaller sliding resistances to the fixing belt 77 which the fixing-belt introducing portion 74-3 and the fixing-belt exit 74-4 slidingly contact. For example, as illustrated in FIG. 7, the contact portions of the fixing-belt introducing portion 74-3 and the fixing-belt exit 74-4 with the fixing belt 77 may be rotational members, e.g., rollers, thus reducing the sliding resistance.

The fixing belt 77 is a belt of a diameter of, for example, 58 mm and including a front layer and a back layer coated by a front release layer and a back release layer. Each of the front layer and the back layer is made of, e.g., highly heat-resistant polyimide resin of a thickness of from 0.05 mm to 0.2 mm. The front release layer may be formed with, for example, a silicon rubber, a fluorocarbon resin, a two-layer structure of a silicon rubber and a fluorocarbon resin, a mixed material of a silicon rubber and a fluorocarbon resin, or other materials, and has elasticity to conform to the concavity and convexity of toners on recording sheets. Further, the back release layer is processed with fluorocarbon resin to reduce the sliding resistance to the stationary member 74. Further, the back release layer may be preferably coated with a lubrication material such as a fluorine grease. Further, as the material of the fixing belt 77, for example, metal, such as stainless steel, nickel, and copper or rubber as well as resins may be used.

The fixing belt 77 having the above-described structure is heated by being wound around the heating roller 78 having a larger diameter and applies heat and pressure to the recording sheet at the fixing nip to fix a toner image on the recording sheet P.

As described above, for the fixing device according to the present exemplary embodiment, not only the stationary member but also the rotary heating member receives the pressure applied to the nip. Such a configuration can form a large width and high surface pressure of fixing nip without the size (and strength) of the stationary member, thus obtaining high-quality images at high speed. Further, since the stationary member has a relatively small size and contacts the rotary heating member, the perimeter of the fixing belt can be shortened, thus allowing downsizing of the fixing device. Further, since the shape of the stationary member can be adjusted to enlarge the curvature of the fixing belt, the above-described configuration can obtain an excellent separation performance, thus allowing natural separation of a recording sheet. Further, since the rotary heating member contacts the fixing belt while rotating, the above-described configuration can obtain an excellent efficiency in heat transmission from the rotary heating member to the fixing belt.

(Second Exemplary Embodiment)

Figure 4:
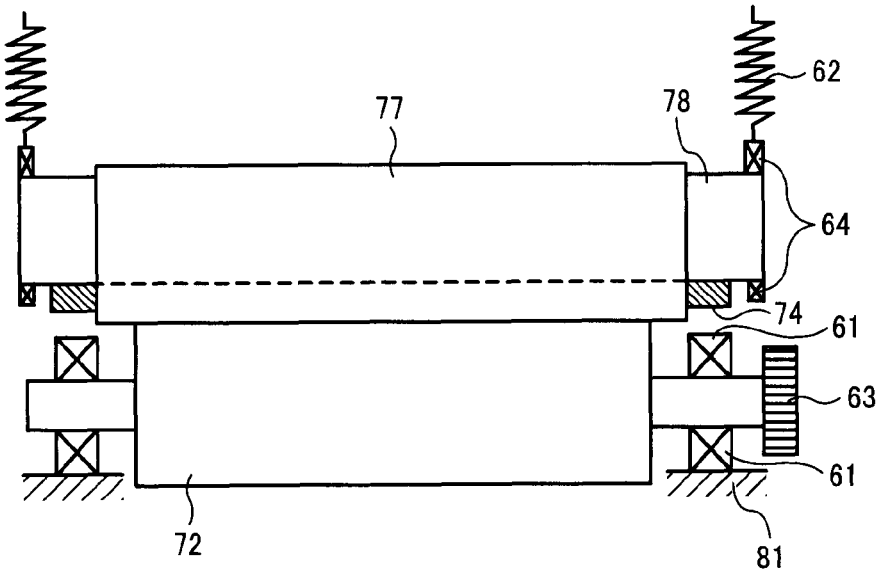
FIG. 4 is a side view of a fixing device according to an exemplary embodiment of the present disclosure.

In the above-described exemplary embodiment, as illustrated in FIG. 3, the pressing unit is provided in the pressure-roller side of the fixing device 25. Alternatively, as illustrated in FIG. 4, the pressing unit may be provided in the heating-roller side of the fixing device 25. In this case, the pressure roller 72 is rotatably fixed at the frame 81 and pressed by the pressing unit including the springs 62 and the pressing levers 82 provided in the heating-roller side of the fixing device 25. Alternatively, the pressing unit may be provided in the heating-roller side and the pressure-roller side of the fixing device 25. In this case, the stationary member 74 is fixed to be pressed from both the heating-roller side and the pressure-roller side.

(Third Exemplary Embodiment)

As described above, the heating roller 78 is rotated by the rotation of the fixing belt 77. Such a configuration can prevent a speed difference between the heating roller 78 and the fixing belt 77, thus suppressing wear of the heating roller 78 and the fixing belt 77.

However, since the heating roller 78 is rotated while sliding over the stationary member 74, if the sliding resistance of the heating roller 78 to the stationary member 74 becomes larger than the force for driving the heating roller 78 transmitted from the fixing belt 77, the heating roller 78 cannot be rotated. If the heating roller 78 cannot be rotated, the efficiency of heating the fixing belt 77 may decrease and, furthermore, may act as a resistance to the rotation of the fixing belt 77, thus preventing the rotation of the fixing belt 77.

Figure 5:
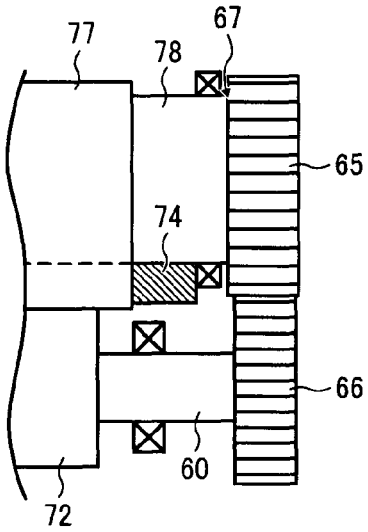
FIG. 5 is a schematic view of a rotation mechanism of a heating roller and a pressure roller.

Hence, as illustrated in FIG. 5, it is preferable to provide a rotary unit including gears 65 and 66 through which the pressure roller 72 and the heating roller 78 are linked and an one-way clutch 67 between the heating roller 78 and the gear 65. In this case, the heating roller 78 is rotated by the rotation of the fixing belt 77, and the gear 65 rotates at a speed lower by several % (e.g., approximately 1% to 5 approximately %) than that of the heating roller 78.

Accordingly, the one-way clutch 67 is in a free state when the rotation speed of the heating roller 78 is higher than the rotation speed of the heating-roller gear 65. By contrast, when the rotation speed of the heating roller 78 decreases due to, for example, slip, the one-way clutch 67 is locked at a state where the rotation speed of the heating roller 78 is equal to the rotation speed of the heating-roller gear 65, thus causing the heating roller 78 to rotate at a rotation speed reduced by several %. As described above, even if slip occurs between the fixing belt 77 and the heating roller 78, the heating roller 78 is rotated to rotate the fixing belt 77, thus preventing the rotation of the fixing belt 77 from being stopped due to the slip.

(Fourth Exemplary Embodiment)

As described above, the fixing belt 77 is rotated by the rotation of the pressure roller 72. However, since the fixing belt 77 is rotated while sliding over the stationary member 74, if the sliding resistance of the fixing belt 77 to the stationary member 74 becomes larger than the force for driving the fixing belt transmitted from the pressure roller 72, the fixing belt 77 cannot be rotated. In particular, when a recording sheet is passing through the fixing nip, the recording sheet P exists between the pressure roller 72 and the fixing belt 77, thus reducing the driving force for driving the fixing belt 77 transmitted from the pressure roller 72. Namely, if the fixing belt 77 cannot be rotated, the recording sheet P cannot be conveyed through the nip.

Hence, as described above (FIG. 5), it is preferable to provide gear coupling between the pressure roller 72 and the heating roller 78 through gears 65 and 66 and to drive the heating roller 78 using a driving unit.

In this case, the speed of the heating roller 78 is set to be substantially equal (±1%) to or higher (by the range of approximately 0% to approximately 10%) than the speed at which the fixing belt 77 is driven by the pressure roller 72.

As described above, the inner surface of the fixing belt 77 is processed with fluorocarbon resin and coated with a lubricating material. Accordingly, the surface of the fixing belt 77 contacting the heating roller 78 tends to slip. As a result, even when the heating roller 78 is rotated at a speed differing from that of the fixing belt 77, the fixing belt 77 slips over the heating roller 78 in a stable manner. Accordingly, the fixing belt 77 is normally traveled, while the fixing belt 77 can be driven. However, there is a need for paying attentions to wear degradation due to the speed difference between the heating roller 78 and the fixing belt 77.

As described above, when a recording sheet is being conveyed through the fixing nip, the driving force for driving the fixing belt 77 transmitted from the pressure roller 72 may decrease. However, for this configuration, the heating roller 78 creates a driving force for driving the fixing belt 77, preventing the rotation of the fixing belt 77 from being stopped. Further, since the heating roller 78 is rotated by a driving unit, this configuration can prevent the rotation of the heating roller 78 from stopping due to slip between the fixing belt 77 and the heating roller 78.

The heating roller 78 may be rotated at a speed lower than the speed of the fixing belt 77. In this case, however, the heating roller 78 may act as a resistance to the rotation of the fixing belt, and as a result, the fixing belt may be loosened at the nip exit, thus resulting in unstable sheet separation performance. Hence, it is preferable to rotate the heating roller 78 at the same speed (±1%) as that of the fixing belt 77 or at a higher speed than that of the fixing belt 77 (by the range of approximately 0% to approximately 10%).

(Fifth Exemplary Embodiment)

Figure 6:
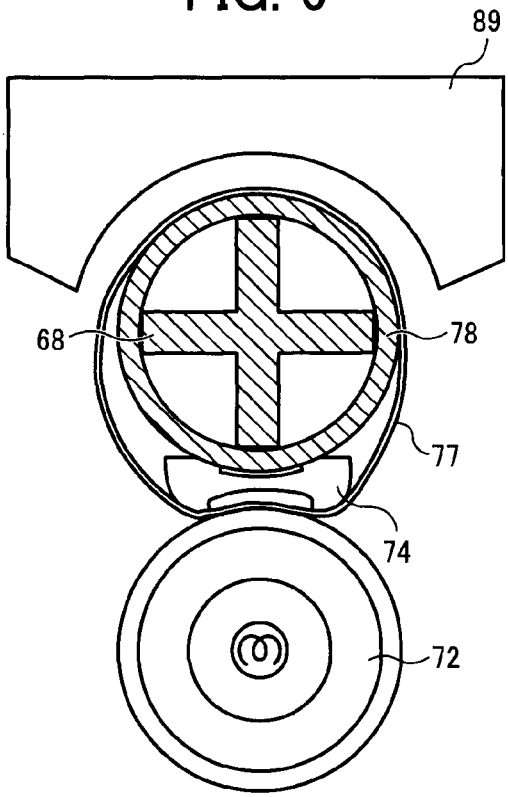
FIG. 6 is a schematic view of a fixing device including an induction heating device as a heat source.

As illustrated in FIG. 6, the fixing device 25 may include an induction heating device 89. The induction heating device 89 is disposed near and away from the outer surface of the fixing belt 77 at a certain distance to heat a heat-generating layer provided in the layers of the fixing belt 77. The induction heating device 89 may be disposed near the inner surface of the heating roller to heat the heating roller 78 and indirectly heat the fixing belt 77.

By employing the induction heating device 89 near the outer surface of the fixing belt 77, the heating roller 78 need not necessarily include a heat source inside it. Accordingly, as illustrated in FIG. 6, a rib 68 may be provided on the inner surface of the heating roller 78 to increase the strength thereof, thus allowing the heating roller 78 to receive higher surface pressure.

The fixing device 25 having the above-described structure is employed in the image forming apparatus 100 illustrated in FIG. 1, thus allowing the image forming apparatus to perform the above-described functions.

Numerous additional modifications and variations are possible in light of the above teachings. It is therefore to be understood that within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A fixing device comprising:

a rotary heating member;

a heat source disposed near the rotary heating member to heat the rotary heating member;

a stationary member disposed in sliding contact with a portion of an outer circumferential surface of the rotary heating member;

a flexible fixing belt looped around the rotary heating member and the stationary member; and a rotary pressure member disposed in pressure contact with the stationary member via the fixing belt to form a nip between the fixing belt and the rotary pressure member through which a recording medium passes, wherein a pressing force acting between the rotary heating member and the rotary pressure member via the fixing belt and the stationary member creates pressure at the nip, and wherein the stationary member has a width greater than a width of the nip between the fixing belt and the rotary pressure member.

2. The fixing device according to claim 1, further comprising:

a frame that supports the rotary heating member rotatably and the stationary member reciprocally movable in a direction in which pressure is applied to form the nip; and a pressing unit that presses the rotary pressure member toward the rotary heating member to form the nip between the fixing belt and the rotary pressure member.

3. The fixing device according to claim 1, further comprising:

a frame that supports the rotary pressure member rotatably and the stationary member reciprocally movable in a direction in which pressure is applied to form the nip; and a pressing unit that presses the rotary heating member toward the rotary pressure member to form the nip between the fixing belt and the rotary pressure member.

4. The fixing device according to claim 1, further comprising a rotary unit that drives the rotary pressure member to rotate, causes the fixing belt to rotate in accordance with rotation of the rotary pressure member, and drives the rotary heating member to rotate independent of the rotation of the rotary pressure member.

5. The fixing device according to claim 1, further comprising a rotary unit that drives the rotary pressure member to rotate, causes the fixing belt to rotate in accordance with rotation of the rotary pressure member, and causes the rotary heating member to rotate in accordance with rotation of the fixing belt, and drives the rotary heating member to rotate when a rotation speed of the rotary heating member is lower than a rotation speed of the fixing belt.

6. A fixing device comprising:

a rotary heating member;

a heat source disposed near the rotary heating member to heat the rotary heating member;

a stationary member disposed in sliding contact with a portion of an outer circumferential surface of the rotary heating member;

a flexible fixing belt looped around the rotary heating member and the stationary member;

a rotary pressure member disposed in pressure contact with the stationary member via the fixing belt to form a nip between the fixing belt and the rotary pressure member through which a recording medium passes; and a roller provided at the stationary member, wherein a pressing force acting between the rotary heating member and the rotary pressure member via the fixing belt and the stationary member creates pressure at the nip, and wherein the stationary member contacts the rotary heating member via the roller.

7. A fixing device comprising:

a rotary heating member;

a heat source disposed near the rotary heating member to heat the rotary heating member;

a stationary member disposed in sliding contact with a portion of an outer circumferential surface of the rotary heating member a flexible fixing belt looped around the rotary heating member and the stationary member;

a rotary pressure member disposed in pressure contact with the stationary member via the fixing belt to form a nip between the fixing belt and the rotary pressure member through which a recording medium passes; and a roller provided at the stationary member, wherein a pressing force acting between the rotary heating member and the rotary pressure member via the fixing belt and the stationary member creates pressure at the nip, and wherein the stationary member contacts the fixing belt via the roller at at least one of an entry and an exit of the nip.

8. The fixing device according to claim 1, wherein the rotary heating member has a hollow cylindrical shape and the heat source is an infrared heater disposed within the rotary heating member.

9. The fixing device according to claim 1, wherein the heat source is an induction heater disposed within the rotary heating member.

10. The fixing device according to claim 1, wherein the heat source is an induction heater disposed outside the rotary heating member.

11. An image forming apparatus comprising:

a fixing device, the fixing device including:

a rotary heating member, a heat source disposed near the rotary heating member to heat the rotary heating member, a stationary member disposed in sliding contact with a portion of an outer circumferential surface of the rotary heating member, a flexible fixing belt looped around the rotary heating member and the stationary member, and a rotary pressure member disposed in pressure contact with the stationary member via the fixing belt to form a nip between the fixing belt and the rotary pressure member through which a recording medium passes, wherein a pressing force acting between the rotary heating member and the rotary pressure member via the fixing belt and the stationary member creates pressure at the nip, and wherein the stationary member has a width greater than a width of the nip between the fixing belt and the rotary pressure member.

12. The fixing device according to claim 1, wherein the stationary member contacts the portion of the outer circumferential surface of the rotary heating member at two distinct contact points, which points are symmetrical with respect to the stationary member, and wherein rollers are disposed on the stationary member at the two distinct contact points.

13. The fixing device according to claim 1, wherein the stationary member contacts the portion of the outer circumferential surface of the rotary heating member at two distinct contact points, which points are symmetrical with respect to the stationary member, and wherein the stationary member includes a heat-resistant elastic member that extends along a length and a width of a base of the stationary member adjacent the fixing belt.

14. The fixing device according to claim 13, wherein the heat-resistant elastic member is disposed between two secondary distinct contact points where the stationary member contacts the fixing belt.

15. The fixing device according to claim 14, wherein rollers are disposed on the stationary member at the two secondary distinct contact points.

* * * * *